United States Patent [19]

Nakazawa et al.

[11] 4,415,126

[45] Nov. 15, 1983

[54] TRAVERSE MOTION FOR USE WITH APPARATUS FOR WINDING CONTINUOUS ELONGATE ELEMENTS

[75] Inventors: Kogi Nakazawa; Michio Sato; Shin Kasai; Yutaka Kawaguchi; Toshiaki Kikuchi, all of Fukushima, Japan

[73] Assignee: Nitto Boseki Co., Ltd., Fukushima, Japan

[21] Appl. No.: 332,146

[22] Filed: Dec. 18, 1981

[30] Foreign Application Priority Data

Dec. 24, 1980 [JP] Japan ..... 55-182998

[51] Int. Cl.[3] ..... B65H 54/30

[52] U.S. Cl. ..... 242/43 R; 242/158.3

[58] Field of Search ..... 242/43 R, 158.3, 158.5

[56] References Cited

U.S. PATENT DOCUMENTS

| | | | |
|---|---|---|---|
| 3,089,657 | 5/1963 | Chaussy | 242/43 R |
| 3,407,262 | 10/1968 | Snyder, Jr. | 242/43 R X |
| 3,900,166 | 8/1975 | Sartori | 242/43 R |
| 4,383,653 | 5/1983 | Nakazawa et al. | 242/43 R |

FOREIGN PATENT DOCUMENTS

| | | |
|---|---|---|
| 1120870 | 4/1956 | France . |
| 1366169 | 6/1964 | France . |
| 1411954 | 8/1965 | France . |

*Primary Examiner*—Stanley N. Gilreath

*Attorney, Agent, or Firm*—Charles A. Blank

[57] ABSTRACT

Apparatus for reciprocating a yarn guide to wind yarn on a bobbin including a rotating scroll cam provided with an endless helical cam groove and a second cam groove in superposed relationship with the endless cam groove and having a greater lead angle than the endless cam groove over a predetermined distance adjacent each turning point. The yarn guide is provided with an elongate ship-shaped cam follower slidably fitted into the endless cam groove and pivotable with respect to the yarn guide and a cylindrical cam follower slidably fitted into the second cam groove. The width of the portion of the endless cam groove adjacent each turning point is gradually increased toward the turning point so as to permit the elongate cam follower to smoothly reverse its direction when it passes the turning point.

2 Claims, 9 Drawing Figures

TRAVERSE MOTION FOR USE WITH APPARATUS FOR WINDING CONTINUOUS ELONGATE ELEMENTS

BACKGROUND OF THE INVENTION

The present invention relates to generally a traverse motion used in an apparatus for winding continuous elongate elements around spools and more particularly a traverse motion adapted to produce large-diameter packages of strands each consisting of a large number of glass filaments having a large diameter.

In general, conventional bushings used for the production of glass fibers are provided with 400 to 800 orifices and glass filaments drawn through such bushings are 10 to 13 microns in diameter. In order to produce large-diameter roving packages from such glass filaments, two production steps are needed. In the first step, 400 to 800 glass filaments drawn through a single bushing are gathered into a strand which in turn is formed into a tapered cake. In the second step, strands are rewound from 15 to 30 cakes and gathered into a single roving which in turn is wound around a spool.

However, the spinning technique has been recently so developed that 2000 to 4000 glass filaments of 15 to more than 20 microns in diameter can be simultaneously drawn through a single bushing and can be gathered into a single strand which in turn is wound around a spool to directly produce a package of a desired diameter. That is, the finished package can be produced by a single step. As a result, high productivity can be attained, but if the prior art winding apparatus is used without any modification, packages of high quality cannot be produced. The requirements for high-quality packages are (1) that each package must have ends which are substantially at right angles to the axis of the package and which are parallel with each other; (2) that the cylindrical surface must be smooth; that is, it must be free from any ridge and valley so that the package must be ideally in the form of a true cylinder with square ends; (3) that the entire length of strand must be uniform in diameter and free from fuzz; (4) that the hardness of the package must be uniform from the cylindrical surface to the core; and (5) that the strand can maintain its stable form even after it has been unwound from the package and impregnated with resins in the succeeding stage.

In the production of such high-quality packages, there exists a problem that due to the delay in response of the motion of the strand to that of the strand guide of a traverse motion, the strand dwells at each of the ends of its reciprocal motion so that the diameter of a finished package becomes greater at the ends than in the intermediate portion thereof. In addition, the higher the traversing speed, the more pronounced the difference in diameter between the ends and the intermediate portion of the finished package. In order to overcome this problem, there has been used a pressure roller which is constantly pressed against the cylindrical surface of a package being formed, thereby making the surface flat. Under such a condition that the non-uniform form of the package is more pronounced, however, the pressure applied to the package being formed is so high that the finished package is deformed. As a result, the strand in the vicinity of the ends of the package is flattened and hardened and tends to slip off from the ends, thereby to destroy the end shape.

In order to solve this problem, the inventors proposed an improved traverse motion whose scroll cam has a specially designed cam groove profile in U.S. Pat. No. 4,383,653. In that traverse motion, the lead angle of an endless helical cam groove is increased at the ends of the scroll cam so that the strand guide can be accelerated at each end of its reciprocating motion. Therefore, the dwell of the strand at the ends of the reciprocating motion of the strand guide can be eliminated by the acceleration of the motion of the guide so that packages with square ends can be produced without the use of a pressure roller. In addition, if a pressure roller is used, an optimum pressure can be applied to the whole cylindrical surface of a package being formed so that the high-quality finished package can be obtained.

The above-described traverse motion, however, has a problem that the cam follower finds it difficult to faithfully follow the cam groove in the vicinity of the turning points of motion at each end of the cam where the lead angle is increased as described above. In general, a ship-shaped cam follower has been used in conjunction with a scroll cam so that it can pass smoothly the intersections between the right- and left-hand cam grooves. This ship-shaped cam follower cannot faithfully follow the cam groove portions where the lead angle is increased as described above.

SUMMARY OF THE INVENTION

One of the objects of the present invention is therefore to provide an improved traverse motion of the type described in the above-mentioned U.S. Pat. No. 4,383,653 so that a cam follower can faithfully follow a cam groove especially at its portions in the vicinity of the turning points of motion where the lead angle of the cam groove is increased.

The present invention uses a cam follower assembly consisting of a cylindrical cam follower and a ship-shaped cam follower. The endless helical cam groove is so designed as to have a doubled structure in such a way that in the intermediate portion thereof between the ends of the cam, only the ship-shaped cam follower engages with the cam groove while the cylindrical cam follower is out of engagement therewith, but in the vicinity of the turning points of motion where the lead angle of the cam groove is increased, the ship-shaped cam follower is released from the cam groove while the cylindrical cam follower engages with the cam groove, whereby it can be securely guided by the cam groove when it is accelerated in motion.

More particularly, the present invention provides a traverse motion for use with an apparatus for winding continuous elongate elements, said traverse motion comprising a scroll cam means having a rotatable cylindrical body and an endless cam groove consisting of at least one pair of right- and left-hand helical grooves formed on the outer surface of said cylindrical body and merging to each other at both ends thereof, the leading angle of said helical grooves being increased over a predetermined distance adjacent to each end thereof, and guide means provided with a cam follower assembly adapted to fit into said helical grooves of said scroll cam means for reciprocal movement in parallel with the axis of said cylindrical body of said scroll cam means to guide said continuous elongate element, wherein said cam follower assembly consists of a first cam follower pivotally attached to said guide means and having such a shape as to be snuggly fitted into said helical grooves and elongated in the direction of the displacement along said helical grooves and a second cylindrical cam follower attached to said guide means coaxially with said first cam follower, said endless cam groove is increased in width in the end portion around each of turning points of the cam groove so as to permit said first cam follower to follow the cam groove to turn as it passes the turning points, and a second cam groove is formed in superposed relationship with said endless cam groove at least in each of end portions around turning points thereof for said second cam follower to be fitted thereinto.

The above and other objects, features and effects of the present invention will become more apparent from the following description of a preferred embodiment thereof taken in conjunction with the accompanying drawings.

DESCRIPTION OF THE PREFERRED EMBODIMENT

Figure 1:
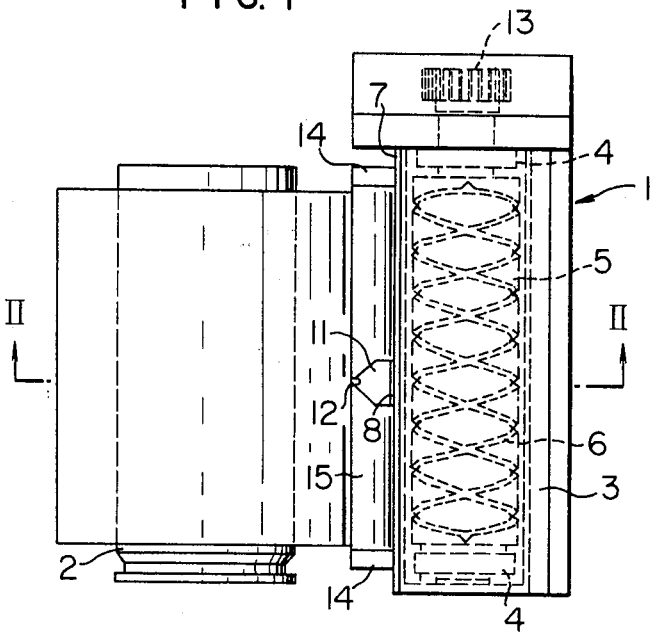
FIG. 1 is a top view of a preferred embodiment of a traverse motion of the present invention.
Figure 2:
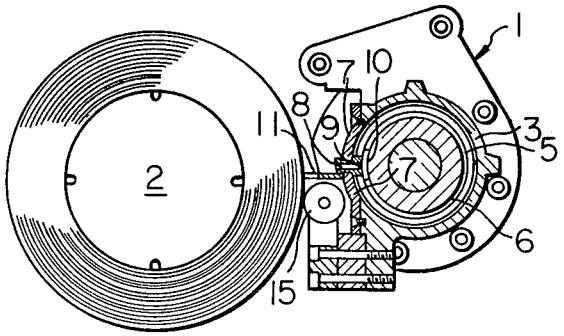
FIG. 2 is a sectional view taken along the line II—II of FIG. 1.

Referring first to FIGS. 1 and 2, a traverse motion generally designated by the reference numeral 1 has a cylindrical scroll cam 5 which is rotatably supported by a pair of axially spaced apart bearings 4 in a housing 3 extended in parallel with a strand winding spool 2. The scroll cam 5 has a helical groove 6 formed on the cylindrical outer surface thereof. The housing 3 has an axially extended opening in opposed relationship with the winding spool 2 and a pair of upper and lower guide rails 7 are axially extended in the opening of the housing 3 and vertically spaced apart from each other by a suitable distance. A sliding member 8 is fitted between the upper and lower guide rails 7 for slidable movement in the axial direction.

Figure 3:
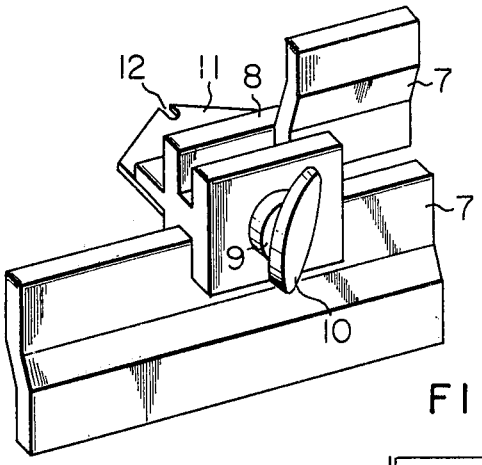
FIG. 3 is a perspective view of a strand guide and parts of guide rails of the traverse motion shown in FIG. 1.

As best shown in FIG. 3, the sliding member 8 is formed with a cylindrical cam follower 9 and a ship-shaped follower 10 located behind the follower 9. The ship-shaped cam follower 10 which is fitted into the cam groove 6 of the scroll cam 5 has opposite side surfaces defined by two similar partial cylindrical surfaces merging to each other at the ends thereof at an acute angle and adapted to engage with the respective side walls of the cam groove 6 and a concaved bottom surface adapted to engage with the convexed bottom of the cam groove 6 and is swingable about the axis of the cylindrical cam follower 9. The sliding member 8 has also a strand guide 11 which is extended horizontally toward the winding spool 2 and has a notch 12 at the leading end thereof.

Referring back to FIGS. 1 and 2, the scroll cam 5 has a timing pulley 13 which is securely attached to one end of the shaft of the cam 5 and is drivingly coupled through a timing belt (not shown) to a prime mover (not shown) so that upon energization of the prime mover the scroll cam 5 is rotated about its axis. A pressure roller 15 is extended in parallel with the axes of the scroll cam 5 and the winding spool 2 and between them and rotatably supported by a pair of axially spaced apart bearings 14 which are attached to the housing 3.

The helical cam groove 6 of the cylindrical scroll cam 5 consists of right- and left-handed grooves which merge to each other at the ends of the scroll cam 5 so that the helical cam groove 6 is endless as a whole. At the end portions the lead angle of the cam groove is greater than in the intermediate portion. In addition, as will be described in detail hereinafter, at each of the merging portions of the right- and left-hand cam grooves and in the proximity thereof, a second cam groove 25 is formed in superposed relationship with the cam groove 6 so that not only the ship-shaped cam follower 10 is slidably fitted into the cam groove 6 but also the cylindrical cam 9 are fitted into and slide through the second cam groove 25. To put into another way, in the intermediate portion where the cam groove 6 has a small lead angle, only the ship-shaped cam follower 10 slides through the cam groove 6, but at and in the proximity of the merging portions at each ends of the cam 5 in which the lead angle is increased, the cylindrical cam follower 9 is forced to follow the second cam groove 25 while the ship-shaped cam follower 10 becomes free; that is, the movement of the follower 10 is not restricted by the cam groove 6. Thus, the movement of the sliding member 8 which slides along the upper and lower guide rails 7 is accelerated in the vicinity of the merging portions of the cam groove 6 or turning points of the sliding member 8 at the ends of the scroll cam 5 and the same is true for the traverse movement of the strand held in the notch 12 at the leading end of the strand guide 11.

The housing 3 is mounted on a suitable mounting means so that with increase in diameter of a package on the winding spindle 2, the traverse motion 1 is gradually retracted away from the package in the direction perpendicular to the axis of the spool 2 while the pressure roller 15 keeps applying a predetermined pressure to the package being wound.

Figure 4:
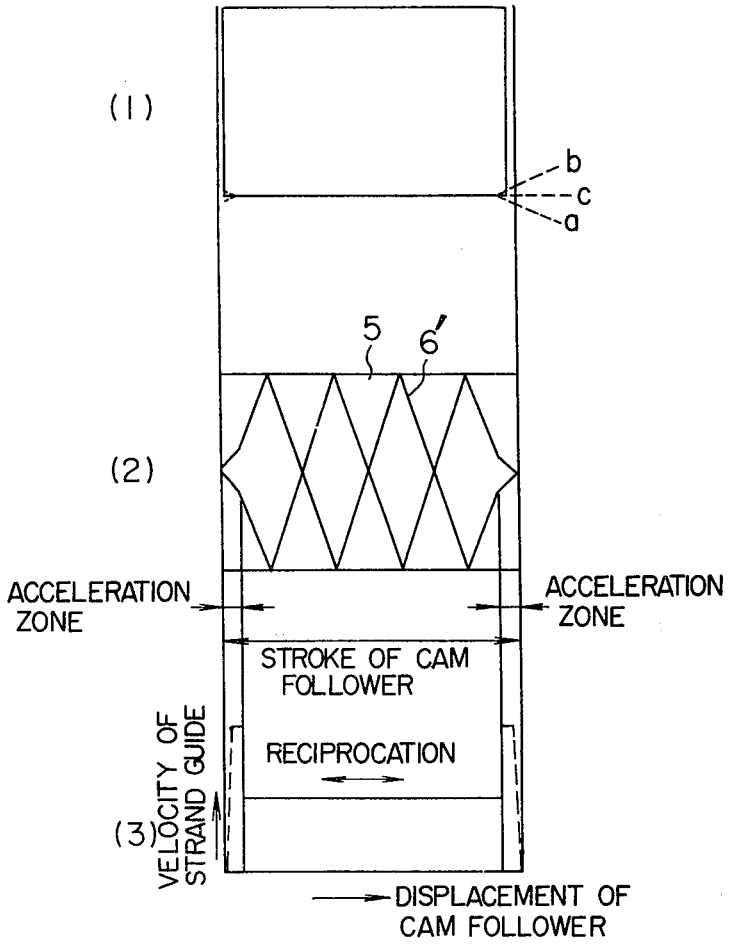
FIG. 4 is a view used to explain the relationships between the cam groove profile of a scroll cam of the traverse motion on the one hand and the velocity of the strand guide and the profile of a finished package.

FIG. 4 shows the relationship between the development (2) of the locus 6' of the center of the cam follower on the one hand and the velocity (3) of the strand guide 11 and the shape of the package (1) on the other hand. As described previously, the lead angle of the cam groove 6 is increased at and in the vicinity of the turning points so that the strand guide is accelerated at and in the vicinity of the turning points. If the lead angle of the helical cam groove 6 were constant throughout its length from one end to the other end of the scroll cam 5 so that the strand guide 11 would not be accelerated at and in the vicintiy of its turning points, the strand would rest at the turning points of the movement due to delay in its response to the strand guide. As a result, the strand which is wound would be inevitably increased in length at both the ends of the package so that the end portions of the package would become greater in diameter than the intermediate portion as indicated by a in FIG. 4.

That is, the finished packages becomes in the form like a hand drum.

On the other hand, when the strand guide 11 is accelerated at its turning points in accordance with the present invention as indicated at (3), there exists no delay in response in the motion of the strand and the motion of the strand is perfectly synchronized with that of the strand guide 11. As a result, at and in the proximity of the turning points of the cam groove 6; that is, the zones in which the motion of the cam follower is accelerated, the number of turns of the strand wound around the package is decreased. As a result, the end portions of the resulting package are smaller in diameter than the intermediate portion as indicated by b in FIG. 4. To put into another way, while the diameter of the finished package is greater at the ends than at the intermediate portion, due to delay in response, according to the present invention the number of turns of the strand is decreased at the ends as indicated by b due to the acceleration of the strand guide 11 so that the finished package has square ends or a constant prescribed diameter throughout its whole length.

The lead angle of the cam groove at and in the vicinity of the turning points must be so determined that the number of undesired turns of the strand at the ends of the package due to the delay in response of the movement of the strand can be correctly cancelled or compensated for by the acceleration of the motion of the strand guide 11 at the ends of its traverse motion. According to the results of extensive experiments conducted by the inventors, the lead angle preferably should be increased by 30% at and in the vicinity of the turning points greater than at the intermediate portion.

Figure 5:
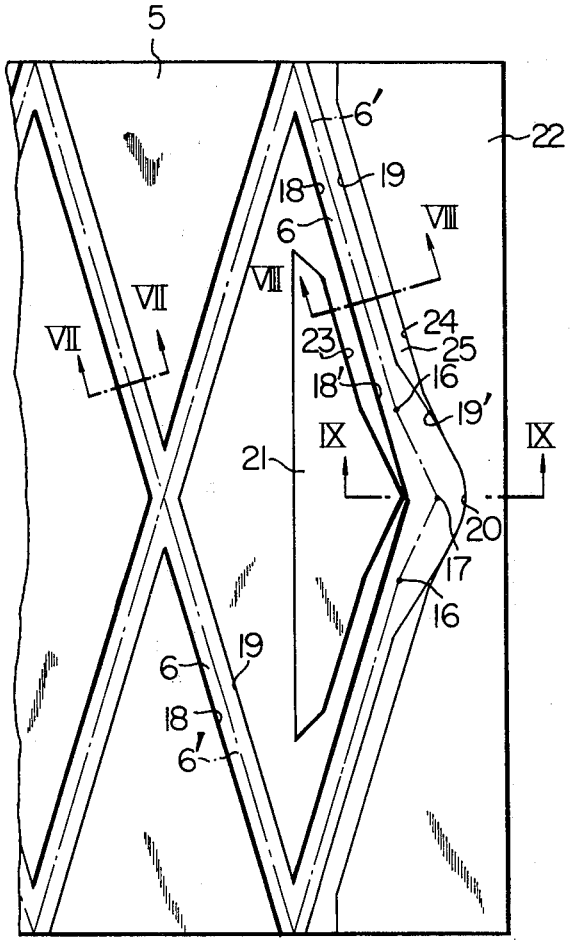
FIG. 5 is a development of the cam groove in the vicinity of one end of the scroll cam.
Figure 6:
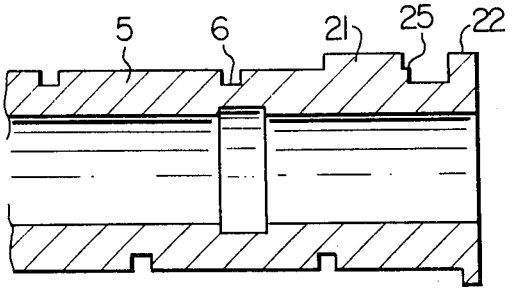
FIG. 6 is a cross sectional view thereof.

In order to ensure that the cam follower can smoothly follow the prescribed constricted motion at and in the vicinity of the turning points of the cam groove formed in the manner as described above, according to the present invention a second cam groove is superposed on the cam groove 6 at each end portion thereof and the cam follower is formed in a doubled structure. Referring to FIGS. 5 and 6, the leading angle of the center line 6' of the cam groove or locus of the center of the cam follower is increased from a point 16 to the turning point 17. The cam groove 6 into which the ship-shaped cam follower 10 is fitted as previously described has in the intermediate portion opposing side walls 18 and 19 in parallel and spaced apart from each other by a distance corresponding to the width of the ship-shaped cam follower 10. The inner side wall 18' of the cam groove 6 in the acceleration zone between the leading angle changing point 16 and the turning point 17 is extended in line with the side wall 18 in the intermediate portion, whereas the outer side wall 19' is tapered outwardly with respect to the side wall 19 in the intermediate portion from a point before the leading angle changing point 16 so as to gradually increase the distance from the inner side wall 18' toward the turning point 17 and formed in an arc 20 at and in the vicinity of the turning point 17.

At each end portion of the scroll cam 5, its cylindrical surface is partially raised to form lands or banks 21 and 22 along the cam groove 6 in opposed relationship so that their opposing side walls 23 and 24 define a second cam groove in superposed relationship with the endless cam groove 6 into which the cylindrical cam follower 9 is fitted. The opposing side walls 23 and 24 of the second cam groove 25 over the entire length thereof are spaced apart from each other by a distance substantially equal to the diameter of the cylindrical cam follower 9 and maintained in parallel with each other and with the locus 6' of the center of the cam follower not only in the intermediate portion but also in the acceleration zone of the cam groove between the lead angle changing point 16 and the turning point 17. The outer side wall 24 of the second cam groove 25 is formed at and in the vicinity of the turning point 17 in an arc coplanar with the arc 20 of the outer side wall of the groove 6 for the ship-shaped cam follower 10. The radius of the arc 20 is substantially equal to that of the cylindrical cam follower 9. It is needless to say that the profiles of both cam grooves as described above are completely symmetrical at the upstream and downstream sides of the turning point 17.

Figure 7:
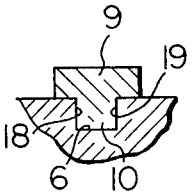
FIGS. 7, 8 and 9 are sectional views taken along the lines VII—VII, VIII—VIII and IX—IX, respectively, of FIG. 5 showing the cross sectional configuration of the cam groove and the cam follower assembly engaged therewith.
Figure 8:
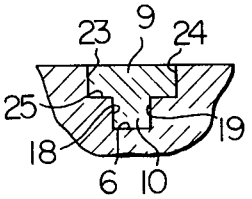
Figure 9:
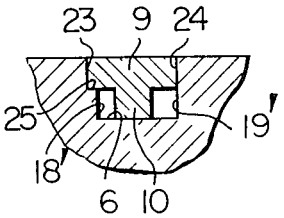

In operation, while the cam follower assembly is in the intermediate portion of the scroll cam, only the ship-shaped cam follower 10 is guided by the cam groove 6 as best shown in FIG. 7. When the cam follower assembly approaches the end of the intermediate portion, the cylindrical cam follower 9 enters the second cam groove 25 so that both the cam followers 9 and 10 are securely guided by the cam grooves 25 and 6, respctively, as best shown in FIG. 8 and thus the cam follower assembly is ready for acceleration. After the cam follower assembly has passed the lead angle changing point 16, the ship-shaped cam follower 10 is released from the side walls 18' and 19' of the cam groove 6, while only the cylindrical cam follower 9 is securely guided by the side walls 23 and 24 of the second cam groove 25, as best shown in FIG. 9, to accelerate the sliding member 8 towards the turning point 17. When the cam follower assembly passes the turning point 17, the ship-shaped cam follower 10 turns to advance towards the opposite end of the scroll cam and the subsequent motion of the cam follower assembly is completely reverse to that as just described.

In summary, according to the present invention, in the constant velocity zone in the intermediate portion of the scroll cam the ship-shaped cam follower 10 is guided by the cam groove 6 so as to ensure the smooth passage of the cam follower through the intersections between the right- and left-hand helical grooves as in the conventional scroll cams but in the acceleration zone at each of the end portions of the scroll cam the ship-shaped cam follower 10 which has poor followability is released from the cam groove 6 to be made inoperative, while the cylindrical cam follower 9 which can quickly respond to the change of lead angle is made operative. In this manner the problem that the cam follower cannot smoothly follow a prescribed motion in the acceleration zone at each end of the scroll cam can be completely solved.

It is to be understood that the present invention is not limited to the preferred embodiment described above and that various modifications may be effected without departing the true spirit of the present invention. For instance, the second cam groove has been described as being provided only at each end portion of the scroll cam, but the second cam groove may be provided throughout the entire length of the scroll cam so that the cylindrical cam follower is guided by the second cam groove even in the intermediate portion of the scroll cam. It will be clear that the latter case also achieves the advantage of the present invention described above, provided that in the acceleration zones at the end portions of the scroll cam the second cam groove has the same profile as in the embodiment as described above.

What is claimed is:

1. A traversing motion for use with apparatus for winding continuous elongate elements, said traversing motion comprising: a scroll cam means having a rotatable cylindrical body and an endless cam groove consisting of at least one right-handed and one left-handed helical groove provided on a surface of said cylindrical body, the grooves merging with each other at both ends thereof; and a second cam groove formed in superposed relationship with said endless cam groove at least in each of end portions around turning points thereof and having a greater lead angle than said endless cam groove over a predetermined distance adjacent each end thereof, and for guiding said elements, guide means provided with a cam follower to fit into said helical grooves of said scroll cam means for reciprocal movement of the guide means in parallel with the rotation axis of said cylindrical body of said scroll cam means, said cam follower being pivotably attached to said guide means and elongate in the direction of displacement along said helical grooves, said guide means having a further cam follower to fit into said second cam groove, said further cam follower being cylindrical and coaxial with said elongate cam follower, in which said elongate cam follower has opposite side surfaces defined by two similar partial cylindrical surfaces merging to each other at the ends thereof at an acute angle, and said endless cam groove is such that, considering a developed view thereof, the inner wall of the cam groove extends substantially linearly to each turning point while the outer wall of the cam groove extends parallel with said inner wall to a first point slightly before a point where the lead angle changes, tapers outwardly from said first point to a second point slightly before the associated turning point so as to gradually increase the distance from said inner wall, and merges at the second point into an arc around said turning point.

2. A traverse motion as set forth in claim 1, wherein said second cam groove is defined between two opposing lands raised from the cylindrical outer surface at each end portion of said scroll cam means.

* * * * *